United States Patent [19]

Bold, Jr.

[11] Patent Number: 4,900,017

[45] Date of Patent: Feb. 13, 1990

[54] INERTIAL FORCE, ACCOMMODATING RESISTANCE EXERCISE DEVICE AND METHOD

[76] Inventor: Thomas P. Bold, Jr., P.O. Box 1564, Springfield, Va. 22151

[21] Appl. No.: 632,824

[22] Filed: Jul. 20, 1984

[51] Int. Cl.[4] ..... A63B 21/22

[52] U.S. Cl. ..... 272/127; 272/122; 272/128

[58] Field of Search ..... 272/128, 93, 117, 126, 272/127, 116, 118, 122, 123, 124; D21/198

[56] References Cited

U.S. PATENT DOCUMENTS

| | | | |
|---|---|---|---|
| 1,058,786 | 4/1913 | Zelner . | |
| 1,113,791 | 10/1914 | Latella . | |
| 1,438,804 | 12/1922 | Albizu . | |
| 1,997,139 | 4/1935 | Gardener et al. . | |
| 2,642,286 | 6/1953 | Leroy | 272/127 |
| 2,821,394 | 1/1958 | Barbeau . | |
| 3,134,590 | 5/1964 | Young . | |
| 3,403,906 | 10/1968 | Burzenski . | |
| 3,482,835 | 12/1969 | Dean . | |
| 3,616,794 | 11/1971 | Gromala | 272/127 X |
| 3,752,475 | 8/1973 | Ott . | |
| 3,796,431 | 3/1974 | Sinyard . | |
| 3,809,393 | 5/1974 | Jones . | |
| 4,134,584 | 1/1979 | Rosenbusch . | |
| 4,171,805 | 10/1979 | Abbott . | |
| 4,225,132 | 9/1980 | Archambault . | |
| 4,339,127 | 7/1982 | Mitchell . | |
| 4,361,324 | 11/1982 | Baroi . | |

FOREIGN PATENT DOCUMENTS

| | | | |
|---|---|---|---|
| 598554 | 10/1959 | Italy | 272/122 |
| 238831 | 8/1925 | United Kingdom | 272/123 |

*Primary Examiner*—Richard J. Apley
*Assistant Examiner*—J. Welsh

[57] ABSTRACT

This invention relates to an inertial force, accommodating resistance exercise device and method. The subject device includes a nonrotating structure of enhanced mass and at least one wheel connected to the nonrotating structure to permit the device to be rolled to enable a user to perform accommodating resistance exercise. The mass of the nonrotating structure may be varied according to the requirements of the exercise by substituting inertial disks of different size and/or an inertial cradle or cage member. In exercises utilizing the instant invention resistance is accommodating in direct proportion to the speed with which the mass of the nonrotating structure is translated and direction in which it is translated.

33 Claims, 3 Drawing Sheets

FIG. 1
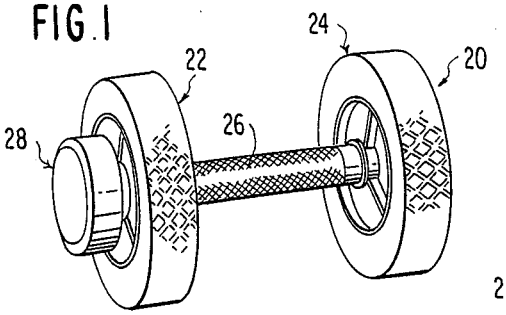
FIG. 5
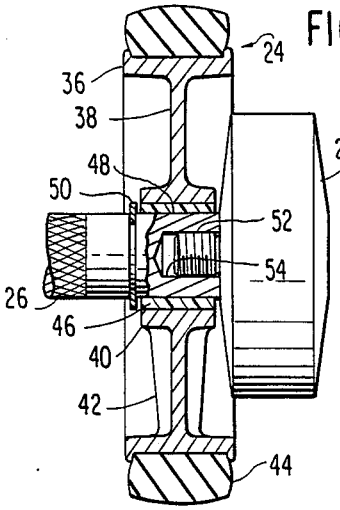
FIG. 2
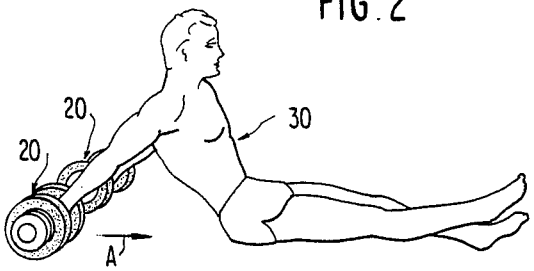
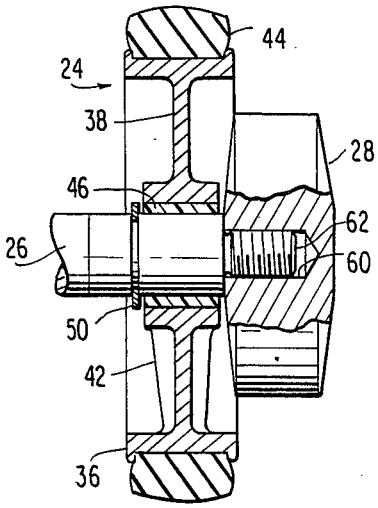
FIG. 6
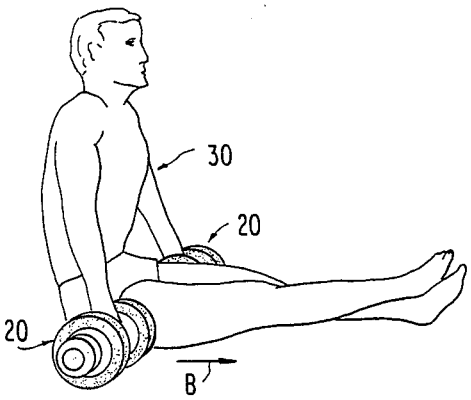
FIG. 3
FIG. 4
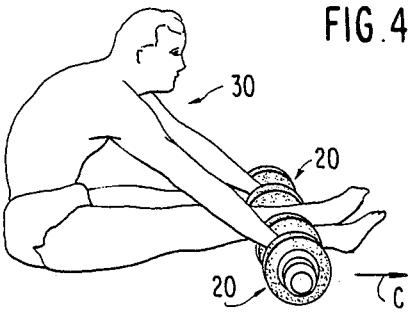

INERTIAL FORCE, ACCOMMODATING RESISTANCE EXERCISE DEVICE AND METHOD

BACKGROUND OF THE INVENTION

This invention relates to an inertial force, accommodating resistance exercise device and method. More specifically, this invention relates to a device and method for generating an opposing force to exercise a user with accommodating resistance primarily through a controlled effort employed by a user of the instant device to overcome inertia of a mass in translation when the device is repeatedly accelerated and decelerated during surface oscillations.

Exercise devices have in common the necessity of enabling a user to experience an opposing force in order to provide resistance to the muscles of the body for the purpose of exercising. This necessity is predicated upon Newton's third law of motion which states that for every force that is exerted by one body on another, there is an equal and opposite force exerted by the second body on the first. The muscles of the body and an exercise device demonstrate the application of this law in an action/reaction combination during the performance of exercise.

With respect to the reaction half of the combination, exercise devices have in the past been designed to take advantage of a variety of forces. Gravity force devices are designed to cause a user to move weight against an opposition provided by the force of gravity, as in the case of barbells or a universal gym. Resilience force devices are designed to cause a user to deform an object such as a spring or elastic band whose resilience properties oppose action by the exerciser. Pneumatic force devices are designed to cause a user to compress or exhaust air in a chamber in order to create opposition, as in the case of most rowing machines. Rotational inertia force devices are designed such that a user experiences resistance when rotation of a metal disk or a flywheel is initiated, as in the case of Nordic ski machines. Friction force devices are designed to cause a user to overcome friction of two interacting surfaces such as between a strap and a flywheel of an exercise cycle. Mechanically-determined force devices are designed to cause a user to overcome the resistance of levers or cables as determined by a speed governor, as in the case of a Cybex machine or a Mini-Gym.

By taking advantage of such forces, exercise devices in the past have enabled a user to perform three basic types of exercise: isotonic, isometric, and accommodating resistance.

Gravity force and resilience force devices are generally used to perform isotonic exercise wherein a muscle shortens and lengthens with varying tension while overcoming and releasing a constant load. In isotonic exercise, the weight or resistance used to exercise is limited to the force that can be overcome at the position or angle where the muscles are weakest in a range of motion. The tension on the muscle is maximal only at that position or angle. In this type of exercise, the speed of motion is relatively slow compared to the rapid movements needed for many sports activities.

Gravity force and resilience force devices are also suited to perform isometric exercise wherein a muscle is given static tension by holding the device in a fixed position. This type of exercise is also commonly performed by pressing against any immovable object. In isometric exercise, there is no motion, and significant gains in strength are specific only to the particular angle or position chosen for the contraction of the muscle.

Exercise devices which take advantage of pneumatic force, friction force, mechanically—determined force, etc., are generally used to perform accommodating resistance exercise (also referred to as isokinetic exercise). In accommodating resistance exercise tension on a muscle varies in direct proportion to the effort expended by the user and is controlled rather than being predetermined by a fixed resistance. Accommodating resistance exercise allows for maximum contraction or tension of a muscle at all joint angles over a full range of joint motion used to perform the exercise and also allows for the speed of movement required for various sports activities to be duplicated by teaching a more efficient activation of muscles by the nervous system. Accommodating resistance exercise, as the basis for a training program, has been rated by many as being superior to isotonic and isometric exercise with respect to rate of strength gain, rate of endurance gain, strength gain over a range of motion, adaptability to specific movement patterns, least possibility of injury, and skill improvement.

In using exercise devices which have been designed to provide accommodating resistance, minimum resistance is experienced when a speed of operation is slow and a greater resistance is experienced when a speed of operation is increased. These devices allow the body to work hard in positions where the body is structured to do hard work and to ease off in positions where the skeletal-muscular system is weak. Rowing machines which employ a pneumatic force to provide opposition, exercise cycles which employ rotational inertia and friction forces to provide opposition, and a Cybex machine which employs a mechanically-determined force to provide opposition are examples of exercise devices which have been designed to take advantage of various opposing forces to enable a user to perform accommodating resistance exercise.

Although machines known in the past have achieved a degree of user acceptance in accommodating resistance training, it would be desirable to create an exercise device capable of taking advantage of an inertial force which is the result of rectilinear or curvilinear translation of an object in order to perform accommodating resistance exercise routines. This type of inertial force is the resistance of an object due to its inertia when the object is accelerated linearly without rotation. (Hereafter, reference to an inertial force will mean an inertial force which is the result of translation of a mass. An inertial force which is the result of rotation of a mass will be so designated.)

An exercise device designed to take advantage of an inertial force is predicated upon what is perhaps the most fundamental property possessed by all objects—inertia. The inertia of an object is a measure of the difficulty in changing the state of rest or motion of the object.

The principles which provide the theoretical basis for an exercise device which enables a user to create and overcome an inertial force to perform accommodating resistance exercise are expressed in Newton's first and second laws of motion. The first law is sometimes referred to as the law of inertia and states that a body continues in a state of rest or motion in a straight line unless it is compelled to change that state by an external force exerted upon it. In other words, because objects possess inertia, an object at rest tends to remain at rest, and an object in motion tends to remain in motion. If the state of rest or motion of an object is altered (start, stop, change direction), a force is needed to accelerate/decelerate the object.

The relationship between an object, force, and acceleration may be expressed in Newton's second law of motion which states that a body acted upon by an external force undergoes an instantaneous acceleration proportional to and in the direction of the force applied to the body. According to this law, the magnitude of force for a given acceleration depends upon the inertia of the object as measured by the object's mass. Simply expressed, the force "F" required to give a mass "m" an acceleration "a" is proportional to both "m" an "a", or $F=ma$.

As previously noted, Newton's third law states that the action of a force to cause acceleration results in a reaction of an equal and opposite force. This reaction force is an inertial force. The equation, $F=ma$, indicates that the magnitude of the inertial force can be modified by varying the size of the mass, while the rate of acceleration remains constant. It indicates the inertial force can be modified by varying the rate of acceleration while the size of the mass remains constant. Controlling the rate of acceleration causes the resistance offered by the inertial force to be accommodating.

An exercise device created to utilize inertial force to provide accommodating resistance would be particularly appropriate for physical conditioning and sports training because inertial forces are commonly experienced in moving one's body and in giving motion to external objects. Inertial forces in physical activities are easy to distinguish by the requirement that they come into existence when initiating, maintaining, and terminating motion. Inertial forces provide the predominant resistance when one gives motion to external objects in activities such as throwing or kicking a ball, swinging a racket or bat, blocking or tackling a player in football, etc. They provide the predominant resistance when one gives rapid motion to one's body or its parts in activities such as jumping, leaping, running, swimming, skating, etc.

One of the benefits of inertial force training has to do with the development of cardiovascular or aerobic fitness. Aerobic fitness is the ability of the heart, blood, and blood vessels to transport oxygen to muscle cells, process the oxygen in those cells, and carry off the resulting waste products. Aerobic fitness is considered by many to be the most important component of overall fitness. Physical activities which produce strong, opposing inertial forces through the rapid motion of one's body advantageously inprove and sustain aerobic fitness.

Inertial forces are involved in most popular physical activities used for cardiovascular development. In running, they are involved in accelerating from a stationary position, in the swinging of the arms and legs, and in the dynamics of landing and takeoff as the body is propelled across a surface by the legs. In swimming, inertial forces are generated in overcoming the inertia of the body in the water, in swinging and kicking the legs, and in overcoming the inertia of the water in repeated stroking and kicking. In rowing, inertia is involved in overcoming the stationary position of a boat, in the resistance offered by the mass of oars, and in overcoming the inertia of water with the oars as the boat is rowed.

In a physiological manner similar to the above popular physical activities, an inertial force exercise device would advantageously contribute to aerobic fitness by featuring an opposition of inertial force in exercises which are continuous and rhythmic and which involve a user's major muscle groups. The use of such a device is further analogous to engaging in aerobic activities such as described above in that the strength of the inertial force can be controlled by varying the rate at which actions are performed, thereby making possible a relatively long—duration participation essential for aerobic conditioning. The aerobic benefit from a device which provides for accommodating resistance is in contrast to an exercise device which solely uses a noninertial force, such as gravity, to create an opposing force required for exercise wherein the weight being lifted is constant.

In addition to aerobic benefit, another benefit has to do with the development of flexibility. Flexibility is the range of motion possible at the joints. Joint flexibility is an important element of general health and physical fitness. Adequate flexibility is desirable for all individuals and is considered to be a possible preventor of low back pain and some of the aches and pains that accompany aging. In addition, improved performance in many sports activities and the prevention of injury and soreness can result from an appropriate program of flexibility development. Flexibility is joint and activity specific. Physical activities which require the greatest range and frequency of movement about a joint and which require significant effort to overcome inertial forces in accomplishing the movement are those which contribute most to flexibility. In this regard, swimming, handball, squash, Nordic and Alpine skiing, and tennis are rated very highly. Therefore, the creation of an inertial force exercise device would provide the user opportunities to contribute to the flexibility of the joints of arms and legs through the opposition of inertia to muscles, ligaments, and tendons. Swinging and reaching motions would closely approximate the rapid motions in the physical activities rated highly for their contribution to flexibility.

Still another benefit of inertial force training has to do with the development of muscular strength and endurance. Muscular strength is the amount of force that can be exerted by a single contraction of particular muscles. Muscular endurance is the length of time an activity can be sustained by particular muscles. Developing and maintaining muscular strength and endurance is best achieved by physical activities which permit the maximum contraction of effort of a muscle through the full range of joint motion and which permit the contraction to be repeated. Physical activities, particularly those which involve rapid and repeated motion by the limbs of the body or which involve the limbs to give rapid and repeated motion to external objects, permit the full exertion of the body's muscular capacity in overcoming the inertia of the limb or the limb in combination with an external object. Therefore, physical activities that overcome strong inertial forces provide a means of increasing and sustaining muscular strength and endurance in a way considered to be most desirable.

Examples of activities which permit a maximum and repeated contraction of a muscle or muscle group through a range of motion required to perform the activity include swimming, wherein the limbs may experience maximum resistance from the water; rowing, wherein maximum resistance may be experienced from the water through the oars; skating, wherein the legs may experience maximum resistance in pushing off against a surface; boxing, wherein the arms may experience maximum resistance in swinging and striking; etc.

Physical activities such as described above permit a maximum contraction of muscles through a specified range of motion because the resistance provided by inertial forces is accommodating. The magnitude of the inertial force, or opposing force is dependent on the acting force of the body. That is to say, the resistance experienced by the muscles at any point during an acceleration will be dependent upon the force the muscles are able to exert at that point. The resistance is accommodating in proportion to the changing muscular capability at every point in the range of motion. Accommodating resistance during these activities allows all muscles and muscle groups, irrespective of their relative strength, to undergo maximum contraction during an entire range of motion and for these contractions to be repeated, thereby providing for muscular strength and endurance. Accordingly, it would be highly desirable to create an exercise device which would enable a user to experience the same opportunities to develop and maintain muscular strength and endurance through accommodating resistance offered by an inertial force as physical activities such as those described above.

The invention which is the subject of the instant patent is a device of a mass translation type which has been created primarily to take advantage of translational inertial force as the opposing force necessary for accommodating resistance exercise to provide the benefits described above having to do with developing and maintaining aerobic fitness, flexibility, muscular strength, and muscular endurance.

The subject invention falls in the category of surface—operated exercise devices which are generally rolled on a surface to perform exercises.

In the past, inventions in this category have most often been designed to take advantage of gravity as the means of establishing the opposing force necessary for exercise. One design comprises a single wheel on a shaft. Another design comprises two double-wheeled, foot-mounted devices. Other designs comprise rollable devices—one for each hand—with unique features such as the use of tracks, the use of brakes, the use of resistance springs, the use of casters, etc. Gravity becomes the opposing force as these devices are used in performing exercise to support, raise, or lower the body of the user in relation to the surface.

In addition to taking advantage of gravity as the opposing force, other inventions in this category have been designed to take advantage of the resistance offered by the inertia of a rotating mass. One design comprises two disk-shaped weights as the wheels of the device. Another design comprises spherically-shaped, rotatable weights as the means for rolling the device.

These previous inventions in the category of surface-operated exercise devices require a significant downward force vector to be applied and maintained as a user exerts effort to support the weight of the body and/or to overcome the rotational inertia of the weighted rotating members. This requirement limits the range of exercise that may be performed and the benefits that may be derived therefrom. It limits the freedom and rapidity with which these devices may be moved on a surface. It limits the community of users to those already in the possession of sufficient upper body strength to exert the pressing force required to support the body weight in various attitudes and positions and to rotate mass and to change the direction of rotation.

The difficulties suggested in the preceding are not intended to be exhaustive, but rather indicate a lack of appreciation in the prior art for significance of surface-operated, inertial force exercise devices and methods. Other noteworthy problems may also exist; however, those presented above should be sufficient to demonstrate that surface-operated exercise devices and methods, which use only gravity and/or the inertia of rotating mass as a means of establishing opposition, will admit to worthwhile improvement.

OBJECTS OF THE INVENTION

It is therefore a general object of the invention to provide a novel inertial force, accommodating resistance exercise device and method which will obviate or minimize disadvantages and/or limitations of previously known devices of the type previously described.

It is another general object of the invention to provide a novel inertial force, accommodating resistance exercise device and method which will give an improved means of exercising to develop aerobic fitness, muscular strength, muscular endurance, and flexibility, primarily by taking advantage of an inertial force as the opposing force in performing accommodating resistance exercise.

It is a further general object of the invention to provide a novel inertial force, accommodating resistance exercise device and method which will minimize difficulties of prior surface-operated devices through improvements in exercise techniques offered by mass in translation and the overcoming of inertial forces on a variety of surfaces.

It is a specific object of the invention to provide a novel inertial force, accommodating resistance exercise device and method wherein an inertial mass may be translated on a surface such as a floor or wall in order to generate an inertial force to exercise the body as the device is repeatedly accelerated and decelerated in a oscillating pattern.

It is another object of the invention to provide a novel inertial force, accommodating resistance exercise device and method wherein an inertial mass may be translated easily for the purpose of causing a continuous, rhythmic, and fluid series of actions and reactions in overcoming the inertia of the mass of the structure.

It is a further object of the invention to provide a novel inertial force, accommodating resistance exercise device and method wherein an inertial mass may be varied through an uncomplicated mechanism.

It is yet another object of the invention to provide a novel inertial force, accommodating resistance exercise device and method wherein the device allows an arm or leg a full range of motion during exercise with no interference.

It is still a further object of the invention to provide a novel inertial force accommodating resistance exercising device and method which permits a user to perform a series of exercises in a sitting, standing, kneeling, or lying position on a floor or in a standing or lying position on a wall to strengthen all major muscle groups and develop flexibility, endurance, and aerobic capacity.

It is still another object of the invention to provide a novel inertial force, accommodating resistance exercise device and method which is suitable as a training alternative for physical activities of the athletic variety because exercises using the device duplicate the requirements of those activities with respect to the coordination required, with respect to the muscles employed, with respect to the range of joint action, and with respect to the speed and resistance demands of the movement patterns.

It is yet still another object of the invention to provide a novel inertial force, accommodating resistance exercise device and method which can be used for the general fitness of all age groups and the rehabilitation of injured or weakened limbs, joints, muscles, etc., because the user can vary the inertial force by varying the rate of acceleration of the device to perform accommodating resistance exercise in accordance with the condition and requirements of the user.

It is a further object of the invention to provide a novel inertial force, accommodating resistance exercise device and method which allows a wide range of exercises which are easy to learn and to perform safely in a variety of settings such as a home, office, or gym environment.

It is another object of the invention to provide a novel inertial force, accommodating resistance exercise device and method which is relatively affordable, portable, and versatile thereby providing a means for accomplishing overall fitness which is a significant alternative to more expensive and complex exercise devices available to consumers through fitness centers or through home installation.

It is still another object of the invention to provide a novel inertial force, accommodating resistance exercise device and method which is aesthetically pleasing and entertaining to use because of the continuous, fluid, and rhythmic oscillation of the limbs of the body during exercises analogous to limb movements in running, swimming, skating, etc.

It is yet another object of the invention to provide a novel inertial force, accommodating resistance exercise device and method which offers significant advantages with respect to the simplicity of mechanical operation of the device, the economy of parts in the construction of the device, and the economy of cost in the mass production of the device.

BRIEF SUMMARY OF A PREFERRED EMBODIMENT OF THE INVENTION

A preferred embodiment of the invention which is intended to accomplish at least some of the foregoing objects, comprises a inertial force, accommodating resistance exercise device and method which includes at least a first wheel member operable to engage and roll upon a surface during an exercise routine. An axle extends through the at least a first heel member and is provided with a portion operable to be releasably controlled by a user. The at least a first wheel member is pivotably mounted upon the axle for rotation with respect to the axle to permit the axle to be translated across a surface. At least one inertial mass structure is connected to the axle for translation with the axle without rotation with respect thereto for providing an inertial resistance through nonrotational translation to exercise a user's body and provide overall fitness through accommodating resistance exercise routines.

THE DRAWINGS

Other objects and advantages of the present invention will become apparent from the following detailed description of preferred embodiments thereof taken in conjunction with the accompanying drawings, wherein:

FIG. 1 is an axonometric view of an inertial force, accommodating resistance exercise device in accordance with a preferred embodiment of the invention;

FIGS. 2–4 schematically disclose an accommodating resistance exercise method which may advantageously utilize a inertial force, accommodating resistance exercise device in accordance with the instant invention;

FIG. 5 is a detail view of one end of a inertial force, accommodating resistance exercise device in accordance with an embodiment of the invention which has been partially sectioned to disclose internal structural detail of the device;

FIG. 6 is a cross-sectional view of one end of another preferred embodiment of the invention;

Figure 14:
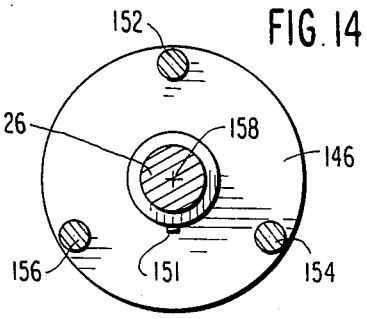
Figure 13:
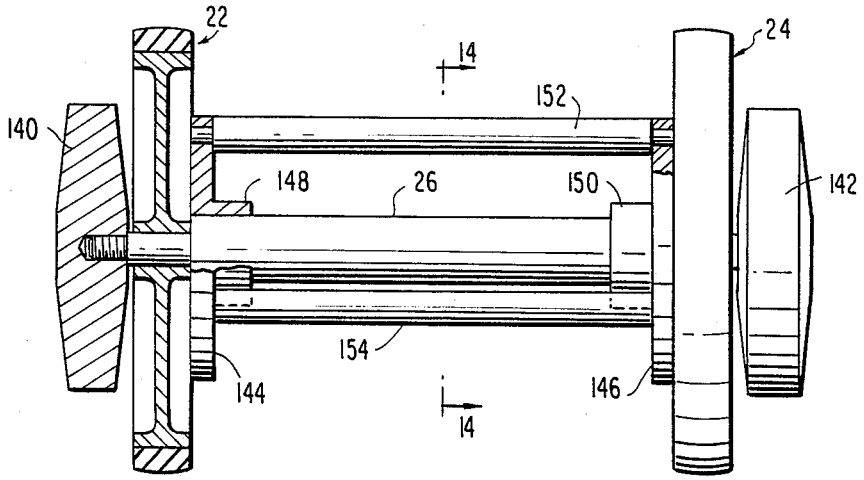

FIG. 13 is a side view of still another embodiment of the invention which has been partially sectioned to disclose internal detail and depicts an enhanced mass comprising a pair of discs and an interconnecting structure of mutually parallel inertial mass bars; and FIG. 14 discloses a cross-sectional view taken along section line 14—14 in FIG. 13 and discloses a symmetrical placement of the inertial mass bars about the end disc of the enhanced mass structure.

DETAILED DESCRIPTION

Referring now to the drawings and particularly to FIG. 1 thereof, there will be seen a inertial force, accommodating resistance exercise device 20 in accordance with one preferred embodiment of the invention. In this connection, the exercise device includes a first wheel member 22 and a second wheel member 24 rotatably mounted upon a central longitudinal axle 26. The first and second wheels are mounted at approximately the ends of the axle 26 and in a mutually parallel posture. The axle is provided with a knurled central portion which may be facilely controlled by a user. An inertial mass 28 is mounted upon the axle 26 at each end thereof and in the embodiment depicted in FIG. 1 in a position upon the axle in a posture outside of the wheels 22 and 24. As will be discussed in detail herein below, the inertial mass is affixed to the axle such that the mass translates with the axle as opposed to rotating with the wheels 22 and 24.

SEQUENCE OPERATION

Before continuing with the detailed description of the subject inertial force, accommodating resistance exercise device, it may be worthwhile to briefly outline the context of the instant invention and disclose of novel method of use of the subject device in accordance with aspect of the invention. In this connection, FIGS. 2–4 schematically disclose a sequence of accommodating resistance exercise. More specifically, a user 30 is shown in FIG. 2 grasping the axles 26 of a pair of exercise devices in accordance with the invention. The user 30 is seated upon a floor surface and has leaned backward, decelerating the accommodating resistance exercise devices as he does so and translating the axles and inertial mass structures in the process.

From a rearward limit, the user 30 pulls the subject exercise devices 20 forward and provides acceleration to the inertial masses 28 in the direction of arrow "A".

As seen in FIG. 3 the user 30 continues to accelerate the accommodating resistance exercise devices 20 of the instant invention in a forward direction as indicated by directional arrow "B" and by doing so contracts those muscles in the arm, torso, and legs needed to produce an acceleration force on the devices 20. As indicated in the foregoing, the amount of user—initiated force is proportional to the mass of the device and the acceleration provided to it. Accordingly the subject invention is accommodating in the sense that the amount of the resistance of the inertial force is dependent and equal to the amount of the user—initiated force as determined by the rate of acceleration imparted by the user 30 and by the mass of the device.

FIG. 4 depicts the user 30 in a posture at approximately the other extreme end of the stroke wherein the isokenetic exercise devices 20 are pushed forward and in the direction of arrow "C" and will soon begin to be decelerated as contractions are actuated in the muscles of the arms, in the back of the legs and back of the user.

In this one exercise routine, once the limit of the user's flexibility is achieved in a forward direction, the inertial force, accommodating resistance exercise devices 20 are rapidly pulled in an opposite direction until the user has returned to the position depicted in FIG. 2. As stated above, the quality and quantity of the exercise is determined by the acceleration applied by the user and the mass of the exercising units 20. During the entire exercise stroke, however, it will be noted that the axle of the inertial force, accommodating resistance exercise device and the inertial masses affixed thereto, do not rotate, but rather, translate along a ground surface. The relatively lightweight wheels 22 and 24 are designed to roll across the ground surface with a minimum amount of friction and thus the user is essentially utilizing in a fluid, oscillatory manner a horizontal translation device in an accommodating resistance exercise routine.

Although FIGS. 2–4 disclose one particular routine. It will be realized by those skilled in the art, however, that a number of other exercise routines are fully contemplated in using the instant exercise device in accordance with the various embodiments of the invention and the number and variety of exercise routines is limited only by the imagination of the user. In this connection, it is also contemplated that a user may attach an exercise devise, in accordance with the invention, to each foot and the devices can be propelled back and forth across a surface by a user's legs. Moreover, while FIGS. 2–4 disclose rolling the device across a generally horizontal floor surface, it is envisioned that an inertial force, accommodating resistance device in accordance with the invention could also be used to advantage by being rolled against a vertical surface such as a wall or the like.

ROLLABLE, ACCOMMODATING RESISTANCE EXERCISE DEVICE

Returning now to FIG. 5 wherein like numerals indicate like parts, there will be seen one preferred embodiment of the instant invention wherein one end portion of the exercise device is depicted in detail at one end of axle 26. An identical mirror image end portion is mounted at the other end of axle 26 as generally depicted in FIG. 1 and therefore all discussion in connection with the wheel member and inertial mass shown applies equally with respect to a wheel member and inertial mass at the other end of the axle.

The wheel assembly 24 of the instant invention is composed of a rim 36 and a disc-shaped connecting web 38 which integrally unites with a central hub 40. The wheel is fashioned from a lightweight material such as an aluminum alloy, nylon, or other polymeric material, and may be cast. In order to provide reinforcing, the disc 38 may be fabricated with radial beams 42 to act as reinforcing spokes. An exterior tire 44 of neoprene rubber or the like is circumferentially mounted upon the rim 36 and possesses characteristics suitable for engaging a ground surface as the device is rolled across the surface in an exercise routine.

In the unit depicted in FIG. 5, a cylindrical bearing sleeve 46 is mounted upon an interior periphery of the hub 40 and is journalled upon a cylindrical bearing surface 48, fashioned upon an outer end of the axle 26. The axle 26 is fitted with an annular bearing ring 50 and the wheel is therefore free to rotate about the axle but prevented from traveling inwardly by the bearing ring 50.

An inertial mass 28 is connected to the axle 26 by an axial extension 52 which is threadedly received within an axial bore 54 of the end of axle 26. The inertial mass 28 is fashioned in the general form of a solid, cylindrical disc having sloping end surfaces for appearance and to ensure free rotation of the wheel 24 and spokes 42 with respect to the inertial mass 28. The inertial mass is preferably composed of cast iron, however, other relatively heavy materials may be utilized as desired.

Turning now to FIG. 6, there will be seen a modified embodiment of the invention wherein the nonrotational inertial mass 28 is releasably connected to the end of axle 26 by being fashioned with an axial threaded bore 60 which is sized and dimensioned to be compatible with a threaded axial extension 62 of the axle 26.

In both of the embodiments depicted in FIGS. 4 and 5, the inertial mass 28 is turned either into or onto an outer end of the axle 26 in a posture outside of an adjacent wheel. The wheel structure is effectively retained between the inertial mass 28 and a bearing ring or rim 50 so that axial travel of the wheel is minimized. In operation, as noted above, a user 30, such as depicted in FIGS. 2–4, will grasp the axle 26 firmly with his hand and translate the exercise device across a surface. The tire 44 of wheel 24 will roll upon the surface while the inertial mass 28, which is releasably attached to the end of axle 26, will translate along with the axle. When it is desired by a user to vary an exercise routine or to change the quality or quantity of the exercise repetitions, the inertial masses 28 may be facilely detached from the axle and replaced with another mass of an increased or decreased quantity as desired.

Figure 7:
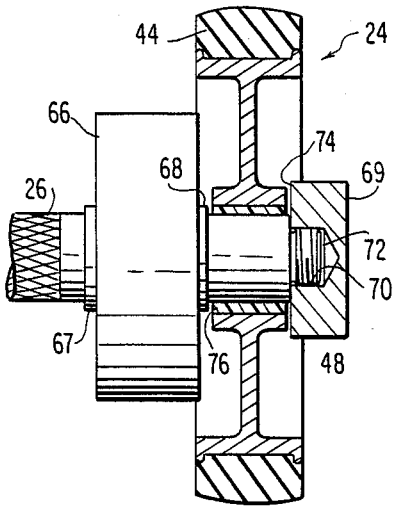
FIG. 7 is a cross-sectional view of an inertial mass mounted upon an axle of an exercise device in accordance with still another embodiment of the invention wherein the inertial mass is isolated from rotational friction forces of an adjacent wheel by a disc.

Turning now to FIG. 7, there will be seen an alternate preferred embodiment of the invention wherein the axial shaft 26 is fitted at approximately one end thereof with an inertial mass disc 66 having a cylindrical bore. The inertial mass disc 66 is slid onto the axle 26 and axially bears against an annular rim or abutment 67. A disc washer 68 is then slid onto the axle and operably serves to isolate the inertial mass 66 from rotational forces of the adjacent wheel 24 during an exercise routine. Accordingly the inertial mass disc 66 translates with the axle during an exercise routine and does not rotate with the wheel 24. Although a disc washer 68 has been advantageously utilized it will be recognized by those skilled in the art that other structural arrangements and devices may be utilized to operably isolate the inertial mass disc 66 from the rotational forces of the wheel 24 and thus facilitate translation of the inertial mass without rotation.

The wheel 24, mounted adjacent to the integral disc 66, is releasably retained in position by a retaining member 69 having a threaded bore 70. The threads on the bore are dimensioned and sized to be compatible with threads on an axial extension 72 which projects outwardly from the end of the shaft 26. An inner face 74 of the retainer 69 cooperates with a peripheral lip 76 on the shaft and functionally serves to maintain the wheel 24 in longitudinal position upon the exercise device.

Figure 8:
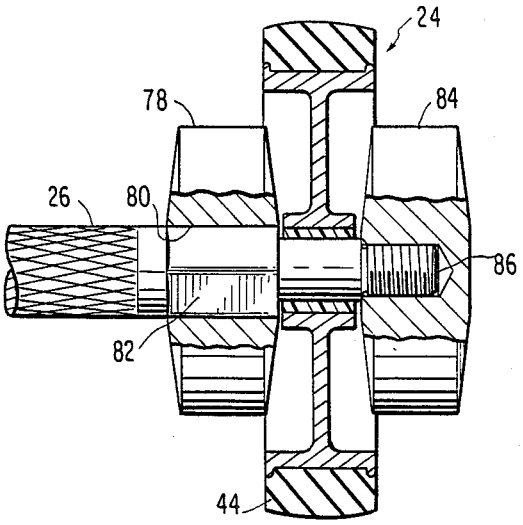
FIG. 8 is a partial cross-sectional view which discloses an embodiment of the invention wherein a first and second inertial mass disc assembly may be varied in accordance with a user's exercise routine.

FIG. 8 discloses an alternate preferred embodiment of the invention wherein an inertial mass 78 is releasably fitted upon the axle 26 in a posture inside of the relatively lightweight wheel 24, as discussed in connection with FIG. 7. In this embodiment, however, the inertial mass 78 is releasably connected to the axle 26 by having an internal axial bore 80 which is designed to range from a regular polygon in cross-section to being keyed onto the shaft 26 such that the interengagement between an exterior surface 82 of the shaft and an interior surface of bore 80 will serve to prevent the inertial mass 78 from rotating relative to the axle 26.

In this embodiment of the instant invention, the retainer 69 is fashioned in the form of a second disc-shaped inertial mass 84 which is threaded onto an axially projecting extension 86 of the shaft 26. The wheel 24, as discussed in connection with prior embodiments, is securely maintained from longitudinal travel between the interior inertial mass 78 and the exterior inertial mass 84. In the event it is desired to vary the mass of the exercise device, the outer inertial mass 84 may be pulled off of the axle, the wheel 24 removed, and the inner inertial mass 78 may be turned off of the axle as well. Alternate heavier or lighter inertial masses may be reassembled upon the axle in accordance with a user's desire and anticipated exercise routine.

Figure 9:
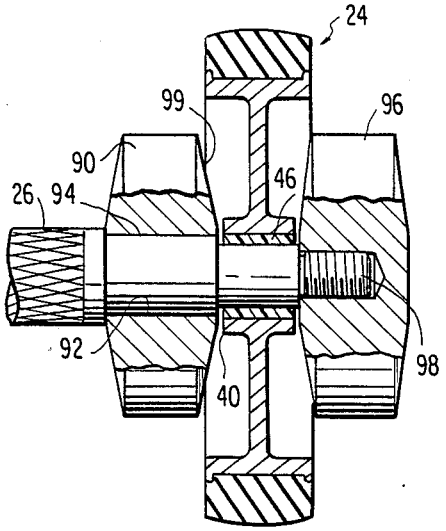
FIG. 9 is a cross-sectional detail view similar to FIG. 8 and discloses an alternate preferred embodiment of the invention.
Figure 10:
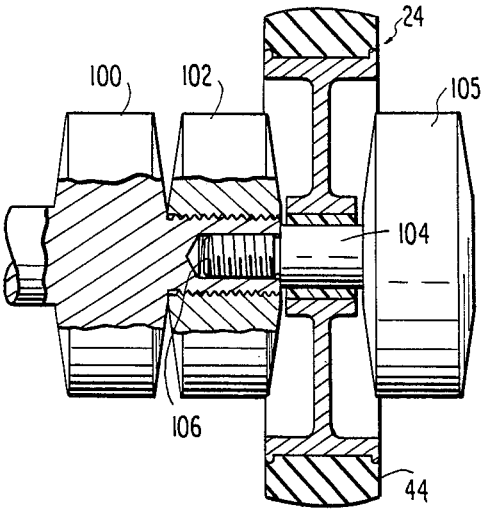
FIG. 10 is a cross-sectional detail view similar to FIGS. 8 and 9 and discloses a further embodiment of the instant invention.

FIG. 9 depicts one end of an inertial force, accommodating resistance exercise device in accordance with yet a further embodiment of the invention wherein an inertial mass 90 is shown with an internal cylindrical bore 92 which is operably received upon an externally cylindrical portion 94 of one end of the axle 26. As discussed in connection with FIG. 8, a wheel 24 is maintained upon the axle by being positioned between an internal inertial mass 90 and an external inertial mass 96 which is threaded upon an axial extension 98 of the axle 26. The internal inertial mass 90 is fashioned with a sloping inner face 99 which provides a minimal rim of contact with the hub 40 and bearing sleeve 46 of the wheel 24. Accordingly, the inertial mass 90 will not rotate with the wheel 24 as the device is rolled upon a surface during an exercise routine. FIG. 10 depicts yet a further modification of the instant invention wherein a first inertial mass 100 is integrally joined with the axle 26 and a second inertial mass 102 is threadedly received upon an extension of the shaft 26. Both of the first and second inertial masses, 100 and 102, are positioned in a posture inside of the generally lightweight plastic wheel 24. In this embodiment, the wheel 24 is journalled upon an axial extension or stub 104 connected to an inertial mass, retainer 105. The stub 104 is threaded into an axial bore 106 of the axle 26 and is thereby joined with the axle and becomes a part of the axle. When assembled the embodiment of FIG. 10 provides an inertial mass, accommodating resistance exercise device which provides an enhanced degree of mass variability to accommodate a wide range of user exercises. Moreover, in this embodiment the wheel 24 may be facile changed by turning off the axle stub 104 and outer, inertial mass retainer 105.

Figure 11:
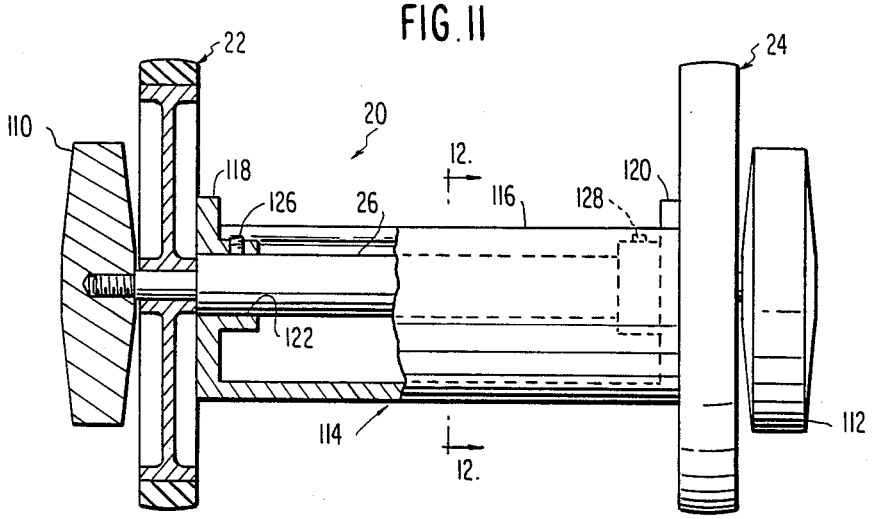
FIG. 11 is a side view of yet another embodiment of an inertial force, accommodating resistance exercise device in accordance with the invention which has been sectioned at one thereof end to disclose a central enhanced mass cradle structure mounted about an axle.
Figure 12:
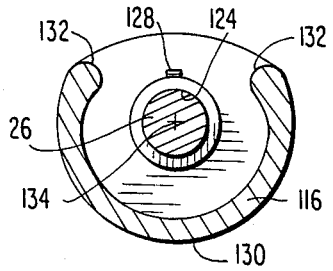
FIG. 12 is a cross-sectional view taken along line 12—12 in FIG. 11 and discloses internal detail of the cradle depicted in FIG. 11.

FIGS. 11 and 12 depict a yet further embodiment of the invention wherein an inertial force, accommodating resistance exercise device 20 in accordance with the invention, is shown with both wheels 22 and 24 mounted upon a central axle 26. Inertial mass disc members 110 and 112 are shown mounted upon the axle 26 at opposing ends thereof in a manner as discussed in connection with the foregoing embodiments.

In the instant embodiment of the invention, the axle 26 is fitted with a cradle inertial mass 114 formed from a trough 116 having a first 118 and second 120 end. The ends are provided with bores 122 and 124, respectively (note FIG. 12) and operably receive the shaft 26. The cradle is maintained upon the shaft and prevented from longitudinally traveling along the shaft by the provision of flange and set screw combinations 126 and 128 connected to the first and second end members, respectively.

As best illustrated in FIG. 12, the trough 116 has a generally "U" or "V" shaped bottom portion 130 and thickened upper edge portions 132. Accordingly, the center of gravity of the trough can be made to lie along a longitudinal axis 134 of the axle 26. Accordingly, the cradle will naturally assume a neutral position without imparting rotational force into a user's wrist.

Turning now to FIGS. 13 and 14, there is yet a further embodiment of the invention wherein a central axle 26 is used to support wheels 22 and 24 in a manner as discussed in connection with prior embodiments. Moreover, an optional inertial disc 140 and 142 may be threaded onto extensions of axle 26 at the outer ends in a manner such as discussed in connection with FIG. 11.

In this embodiment of the invention, the outer disc-shaped inertial masses 140 and 142 may be enhanced by the provision of a first 144 and second 146 disc-shaped end plate. The discs 144 and 146 are provided with central hubs 148 and 150, respectively, which may be secured to the axle 26 by the provision of a set screw such as 151 depicted in FIG. 14. The mass of this enhanced-mass assembly is not only contained in the end most discs 144 and 146, but further is provided by one or more longitudinally oriented, mass enhancing rods 152, 154, and 156, which extend in a mutually parallel posture symmetrically about the axis 158 of axle 26. These rods may be connected at their ends to the discs 144 and 146 by a plurality of conventional techniques or may merely be inserted within bores fashioned into the discs at equal circumferential locations such as shown in FIG. 13. Moreover, the mass of individual rods may be varied to increase the mass of the accommodating resistance exercise device for particular exercise routines.

SUMMARY OF MAJOR ADVANTAGES OF THE INVENTION

After reading and understanding the foregoing description of the invention, in conjunction with the drawings, it will be appreciated that several distinct advantages of the subject inertial force, accommodating resistance exercise device and method are obtained.

Without attempting to set forth all of the desirable features of the instant accommodating resistance exercise device, as specifically and inherently disclosed here and above, at least some of the major advantages of the invention provide the unique provision of variable inertial masses which are connected to an axle for translation across an exercise surface without imparting the force of rotational inertia of the inertial masses to a user's wrists and hands or ankles and legs.

An inertial force, accommodating resistance exercise device in accordance with the various embodiments of the instant invention provide a means of exercising to develop aerobic fitness, muscular strength, muscular endurance and flexibility by the provision of an inertial mass connected to an axle which may be freely translated across an surface. The provision of an inertial mass, which may be translated on a surface such as a floor or wall in order to generate an inertial force, efficiently exercises the body as the device is repeatedly accelerated and decelerated in an oscillating pattern.

The provision of generally lightweight rotating wheels with a frictional tire periphery enables the device to be facilely translated across a surface to provide a continuous, rhythmic, and fluid series of actions and reactions in overcoming the translating inertia of the nonrotating mass of the structure.

The instant invention contemplates a number of preferred embodiments wherein the amount of the inertial mass may be facilely varied to enable the device to be utilized by a wide range of users having variant strengths, flexibility, and endurance.

The provision of specific embodiments wherein enhanced masses may be added to the structure between relatively lightweight rollable wheels enables a user to significantly increase the mass and thus resistance of the exercise device without encumbering its full use. More specifically, in these embodiment a structure may be assembled which will not interfere or contact with an arm or leg during a full range of motion utilizing the exercising device.

The variety and versatility of the device enables a user to perform a series of exercises in a sitting, standing, kneeling, or lying position on a floor; or standing or lying position upon a wall surface suitable to strengthen all major muscle groups and develop flexibility, endurance, and aerobic capacity.

Still further, the nonrotating inertial mass exercise device of the instant invention permits a user to perform exercises as a training alternative for athletic activity in a manner that duplicates the requirements of a range of joint action, speed, etc., which are inherent in physical athletic activities.

The ability of the instant device to be facilely varied in the amount of mass enables the device to be utilized by a wide range of age groups, as well as general fitness of the users, and may even find use as a rehabilitating unit to strength injured or weakened limbs, joints, muscles, etc.

Still further, the subject inertial force, accommodating resistance exercise device provides a full range of exercise activity which may be safely performed in a variety of settings such as a home, office, or gym environment.

In describing the invention, reference has been made to preferred embodiments and illustrative advantages of the invention. Those skilled in the art, however, and familiar with the instant disclosure of the subject invention, may recognize additions, deletions, modifications, substitutions, and/or other changes which will fall within the purview of the subject invention and claims.

What is claimed is:

1. An inertial force, accommodating resistance exercise device for exercising the body through effort required to overcome the inertia of a mass being accelerated and translated during surface oscillations, said exercise device comprising:

an axle means having at least one portion operable to be releasably controlled by a user;

at least one wheel means rotatably mounted upon said axle means and being operable to engage, roll and be accelerated upon a surface during an accommodating resistance exercise routine;

said at least one wheel means including a peripheral surface for engagement with a surface during the exercise routine;

bearing surface means between said axle means and said at least one wheel means for facilitating smooth rotation of said at least one wheel means about said axle means in order to accelerate said exercise device during an exercise routine;

at least one inertial mass structure, said at least one inertial mass structure having a mass exceeding the mass of said at least one wheel, said at least one inertial mass structure being connected to said axle means for acceleration and translation with said axle and without substantial rotation with respect to said axle means for providing an inertial resistance through essentially non-rotational translation when said at least one wheel is rolled and accelerated upon a surface during an accommodating resistance exercise routine; and said one of said at least one inertial mass structure being operably mounted on said axle means independent of any other inertial mass structure; whereby a combination of relatively free rotational movement of said at least one wheel means with respect to said axle means and concomitant essentially non-rotational translation of said at least one inertial mass structure along with said axle means advantageously permits a user to accelerate said exercise device to perform inertial force accommodating resistance exercise routines to exercise a user's body and provide overall fitness.

2. An exercise device as recited in claim 1 above, wherein said at least one inertial mass structure comprises a first and second inertial mass structure, said first and second inertial mass structure being axially spaced along said axle means.

3. An exercise device as recited in claim 2 above, wherein the mass of each said first and second inertial mass structure exceeds the mass of one of said at least one wheel.

4. An exercise device as recited in claim 1 above, wherein said at least one wheel includes a first and second wheel.

5. An exercise device as recited in claim 4 above, wherein said one of said at least one inertial mass structure has a mass exceeding the mass of each said first and second wheel.

6. An exercise device as recited in claim 1 above, wherein said one of said at least one inertial mass structure has a mass exceeding each one of said at least one wheel.

7. An exercise device as recited in claim 1 above, wherein:

said bearing surface means comprises a generally smooth cylindrical inner bearing surface fashioned upon an interior periphery of a hub portion of said at least one wheel means and a compatibility dimensioned generally smooth cylindrical outer bearing surface on said axle means wherein rotational motion of each of said first and second wheel means about said axle means is facilitated.

8. An exercise device as recited in claim 7 wherein:

said generally smooth cylindrical inner bearing surface comprises a bearing sleeve mounted upon an inner periphery of the hub portion of said at least one wheel means.

9. An inertial force, accommodating resistance exercise device as defined in claim 1 wherein said at least one wheel comprises:

a first wheel means mounted at approximately one end of said axle and being operable to engage and roll upon a surface during an exercise routine; and a second wheel means mounted at approximately the other end of said axle and being operable to engage and roll upon a surface during an exercise routine.

10. An inertial force, accommodating resistance exercise device as defined in claim 9 wherein said at least one inertial mass structure comprises:

a first inertial disc mounted upon said axle means, inside of said first wheel means, for translation with said axle means;

a second inertial disc mounted upon said axle means, inside of said second wheel means, for translation with said axle means; and at least three inertial mass bars extending between said first and second inertial discs in a symmetric posture parallel to but offset from said axle means.

11. An inertial force, accommodating resistance exercise device as defined in claim 10 wherein said at least three inertial mass bars comprises:

three inertial mass bars extending between said first and second inertial discs in a symmetric, mutually parallel posture.

12. An inertial force, accommodating resistance exercise device as defined in claim 10 and further comprising:

a first retainer member mounted upon said axle means outside of said first wheel means for retaining said first wheel means upon said axle; and a second retainer member mounted upon said axle outside of said second wheel means for retaining said second wheel means upon said axle.

13. An inertial force, accommodating resistance exercise device as defined in claim 12 wherein:

said first retainer member comprises an inertial disc member mounted upon said axle means in a nonrotational posture with respect to said axle means at said approximately one end thereof; and said second retainer member comprises an inertial disc member mounted upon said axle means in a nonrotational posture with respect to said axle means at said approximately other end thereof.

14. An inertial force, accommodating resistance exercise device as defined in claim 9 wherein said at least one inertial mass structure comprises:

a cradle mounted upon said axle means between said first wheel means and said second wheel means for nonrotational translation with said axle.

15. An inertial force, accommodating resistance exercise device as defined in claim 14 wherein said cradle comprises:

a trough structure having closed ends and a bore through each end to receive said axle means.

16. An inertial force, accommodating resistance exercise device as defined in claim 14 or 15 and further comprising:

a first retainer member mounted upon said axle outside of said first wheel means for retaining said first wheel upon said axle means; and a second retainer member mounted upon said axle outside of said second wheel means for retaining said second wheel upon said axle means.

17. An inertial force, accommodating resistance exercise device as defined in claim 16 wherein:

said first retainer member comprises an inertial disc member mounted upon said axle means in a nonrotational posture with respect to said axle means at said approximately one end thereof; and said second retainer member comprises an inertial disc member mounted upon said axle means in a nonrotational posture with respect to said axle means at said approximately other end thereof.

18. An inertial force, accommodating resistance exercise device for exercising the body through effort required to overcome the inertia of a mass being accelerated and translated during surface oscillations, said exercise device comprising:

a first wheel means operable to engage, roll, and be accelerated upon a surface during an exercise routine;

a second wheel means operable to engage, roll, and be accelerated upon a surface during an exercise routine;

axle means supporting said first wheel means and said second wheel means and having a portion operable to be releasably controlled by a user, and said first and second wheel means being rotatably mounted upon said axle means, at approximately the ends thereof, in a mutually parallel posture for rotation with respect to said axle means upon acceleration and translation of said axle means by a user across a surface during an exercise routine;

bearing surface means between said axle means and each of said first and second wheel means for facilitating smooth rotation of each of said first and second wheel means about said axle means in order to accelerate said exercise device during an exercise routine;

first and second inertial mass structures supported by said axle means for operative acceleration and translation with said axle means and without substantial rotation with respect to said axle means during accommodating resistance exercise routines, for providing an inertial resistance through acceleration and essentially non-rotational translation of said first and second inertial mass structure to exercise a user's body and provide overall fitness;

said first and second inertial mass structures being axially spaced on said axle means from each other; and the mass of each of said first and second inertial mass structures exceeds the mass of each of said first and second wheel means, whereby a combination of relatively free rotational movement of said first and second wheel means with respect to said axle means and concomitant essentially non-rotational translation of said first and second inertial mass structures along with said axle means advantageously permits a user to accelerate said exercise device to perform inertial force accommodating resistance exercise routines to exercise the body.

19. An exercise device as recited in claim 18 above, wherein:

said bearing surface means comprises a generally smooth cylindrical inner bearing surface fashioned upon an interior periphery of a hub portion of each of said first and second wheel means and compatably dimensioned generally smooth cylindrical outer bearing surfaces on said axle means wherein rotational motion of each of said first and second wheel means about said axle means is facilitated.

20. An exercise device as recited in claims 19 wherein:

said generally smooth cylindrical inner bearing surface comprises a bearing sleeve mounted upon an inner periphery of the hub portion of each of said first and second wheel means.

21. An inertial force, accommodating resistance exercise device as defined in claim 18 wherein said first and second inertial mass structure are respective first and second inertial disc members each having a central axis and being coaxially mounted at approximately opposing ends of said axle means adjacent to a respective one of said first and second wheel means.

22. An inertial force, accommodating resistance exercise device as defined in claim 21 wherein:

said first inertial disc member is mounted upon said axle means outside of said first wheel means; and said second inertial disc member is mounted upon said axle means outside of said second wheel means.

23. An inertial force, accommodating resistance exercise device as defined in claim 22 wherein:

each end of said axle means is fashioned with a coaxial threaded bore; and each of said first and second inertial disc members is provided with an axially projecting, threaded member dimensioned to be threadably received by the bores within the axle means for releasably mounting said first and second inertial disc members upon said axle means in a nonrotational posture with respect to said axle means.

24. An inertial force, accommodating resistance exercise device as defined in claim 22 wherein:

each end of said axle means is fashioned with a coaxial threaded extension; and each of said first and second disc members is provided with an axially extending threaded bore dimensioned to be threadably received upon the axle extensions, in a nonrotational posture with aspect to said axle means, for releasably mounting said first and second inertial disc members upon said axle means.

25. An inertial force, accommodating resistance exercise device as defined in claim 21 wherein:

said first inertial disc member is mounted upon said axle means inside of said first wheel means; and said second inertial disc member is mounted upon said axle means inside of said second wheel means.

26. An inertial force, accommodating resistance exercise device as defined in claim 25 and further comprising:

disc means mounted upon said axle means between each of said first and second inertial disc members and said first and second wheel means respectively, to isolate said first and second inertial disc members from rotational forces of said first and second wheel means during accommodating resistance exercise routines.

27. An inertial force, accommodating resistance exercise device as defined in claim 25 wherein:

a first retaining member is mounted upon said axle means outside of said first wheel means for retaining said first wheel upon said axle means; and a second retaining member is mounted upon said axle means outside of said second wheel means for retaining said second wheel means upon said axle means.

28. An inertial force, accommodating resistance exercise device as defined in claim 27 wherein:

said first retaining member comprises an inertial disc member mounted upon said axle means in a nonrotational posture with respect to said axle means at said approximately one end thereof; and said second retaining member comprises an inertial disc member mounted upon said axle means in a nonrotational posture with respect to said axle means at said approximately other end thereof.

29. An inertial force, accommodating resistance exercise device as defined in claim 25 or 28 wherein:

said first inertial disc member is integrally joined upon said axle means at said approximately one end thereof; and said second inertial disc member is integrally joined upon said axle means at said approximately the other end thereof.

30. An inertial force, accommodating resistance exercise device as defined in claim 25 or 28 wherein:

said first inertial disc member has an axial bore which is at least not continuously circular in cross-section and said disc member is operable to be axially slid onto nonrotatable engagement with a compatibly dimensioned outer surface of said axle means at said approximately one end thereof; and said second inertial disc member has an axial bore which is at least not continuously circular in cross-section and said disc member is operable to be axially slid onto nonrotational engagement with a compatibly dimensioned outer surface of said axle means at said approximately other end thereof.

31. An inertial force, accommodating resistance exercise device as defined in claim 25 or 28 wherein:

said first inertial disc member has a threaded axial bore and is threaded onto nonrotational engagement with a compatibly dimensioned and threaded outer surface of said axle means at said approximately one end thereof; and said second inertial disc member has a threaded axial bore and is threaded onto nonrotational engagement with a compatibly dimensioned and threaded outer surface of said axle means at said approximately the other end thereof.

32. An inertial force, accommodating resistance exercise device as defined in claim 25 or 28 wherein:

said first inertial disc member comprises at least one inertial disc integrally joined upon said axle means at said approximately one end thereof, and at least a second inertial disc releasably mounted upon said axle means adjacent to said at least one inertial disc integrally joined upon said axle means at said approximately one end thereof; and said second inertial disc member comprises at least one inertial disc integrally joined upon said axle means at said approximately the other end thereof and at least a second inertial disc releasably mounted upon said axle means adjacent to said at least one inertial disc integrally joined upon said axle means at said approximately the other end thereof.

33. An inertial force, accommodating resistance exercise device as defined in claim 21 and further comprising:

means for permitting variation of the mass of said first and second disc members for increasing or decreasing inertial opposition during an exercise routine according to the requirements of an exercise and strength of a user.

* * * * *